US009812826B2

(12) United States Patent
Yu et al.

(10) Patent No.: US 9,812,826 B2
(45) Date of Patent: Nov. 7, 2017

(54) ELECTRICAL CONNECTOR WITH GROUNDING CONTACT

(71) Applicant: ALLTOP ELECTRONICS (SUZHOU) LTD., Taicang, JiangSu Province (CN)

(72) Inventors: Wang-I Yu, New Taipei (TW); Mao-Jung Huang, New Taipei (TW); Ya-Juan Gou, Taicang (CN); Dan Li, Taicang (CN); Qing-Fang Deng, Taicang (CN)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 15/345,709

(22) Filed: Nov. 8, 2016

(65) Prior Publication Data

US 2017/0250508 A1 Aug. 31, 2017

(30) Foreign Application Priority Data

Feb. 26, 2016 (TW) ..... 105106027 A

(51) Int. Cl.

| | |
|---|---|
| ***H01R 24/60*** | (2011.01) |
| ***H01R 24/64*** | (2011.01) |
| ***H01R 13/6581*** | (2011.01) |
| ***H01R 13/631*** | (2006.01) |
| *H01R 107/00* | (2006.01) |

(52) U.S. Cl.
CPC ..... *H01R 24/64* (2013.01); *H01R 13/631* (2013.01); *H01R 13/6581* (2013.01); *H01R 2107/00* (2013.01)

(58) Field of Classification Search
CPC ..... H01R 24/60
See application file for complete search history.

(56) References Cited

U.S. PATENT DOCUMENTS

2016/0099526 A1* 4/2016 Chen ..... H01R 13/5045 439/607.05

* cited by examiner

*Primary Examiner* — Ross Gushi
(74) *Attorney, Agent, or Firm* — Sughrue Mion, PLLC

(57) ABSTRACT

A connector for electrically connecting with a complementary connector, includes an insulating housing, a number of conductive contacts, and a shielding shell. The insulating housing includes a base, a mating tongue extending forwards from the base, and a number of channels extending through the mating tongue and the base. The conductive contacts are retained in the channels, with each conductive contact having a fixing portion assembled within corresponding channel, a contacting portion extending from one side of the fixing portion and a soldering portion extending from the other side of the fixing portion opposite to the contacting portion. The shielding shell covers the insulating housing and the number of conductive contacts. One of the contacts is employed for grounding purpose.

16 Claims, 11 Drawing Sheets

ELECTRICAL CONNECTOR WITH GROUNDING CONTACT

BACKGROUND

1. Technical Field

The present disclosure relates to an electrical connector, and more particularly to an electrical connector with grounding contact for mounting onto a printed circuit board.

2. Description of Related Art

The USB-IF announced USB Type-C™ standards in 2014. This kind of connector of USB Type-C™ features double-direction insertions. In the same time, the transmission rate and shielding performance are improved. This type of connector is secure to the complementary connector by a pair of latching arms of a central pad which complicate the production and the assembly of the connector.

Hence, there is a need to improve such kind of connector.

SUMMARY

The present disclosure includes a connector for electrically connecting with a complementary connector. The connector comprises an insulating housing, a plurality of conductive contacts, and a shielding shell. The insulating housing comprises a base, a mating tongue extending forwards from the base, and a plurality of channels extending through the mating tongue and the base. The conductive contacts are retained in the channels. Each conductive contact has a fixing portion assembled within corresponding channel, a contacting portion extending from one side of the fixing portion and a soldering portion extending from the other side of the fixing portion opposite to the contacting portion. The shielding shell covers the insulating housing and the plurality of conductive contacts. One of the contacts is employed for grounding purpose. The grounding contact defines a latching portion neighbored and connected to the contacting portion thereof. The mating tongue has a cutout recessed from a lateral edge thereof, and the latching portion of the grounding contact cooperates within the cutout.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
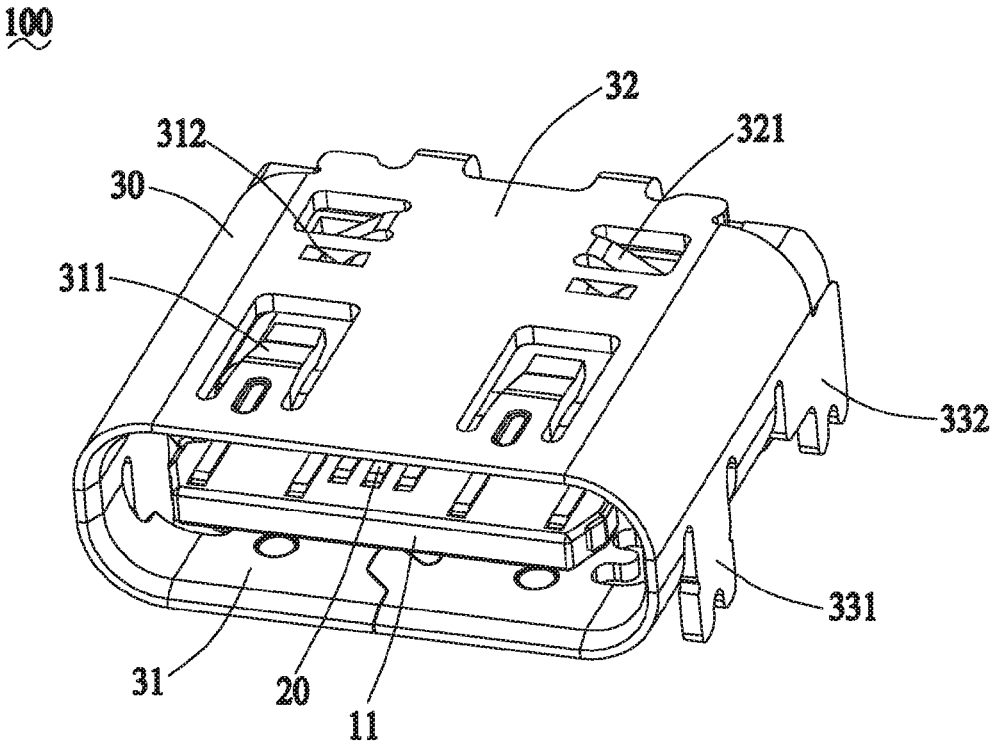
FIG. 1 is a perspective view of an electrical connector of the first embodiment in accordance with the present invention.

Reference will now be made to the drawing figures to describe the embodiments of the present disclosure in detail. In the following description, the same drawing reference numerals are used for the same elements in different drawings.

Referring to FIGS. 1 to 8, an illustrated first embodiment of the present invention discloses an electrical connector 100 which complies to standard USB Type-C™. The electrical connector 100 is employed to mounted onto a printed circuit board (not shown) and engages with a complementary connector (not shown). The electrical connector 100 includes an insulating housing 10, a plurality of conductive contacts 20 received in the insulating housing 10 and a shielding shell 30 covering the insulating housing 10 and the plurality of conductive contacts 20.

Figure 2:
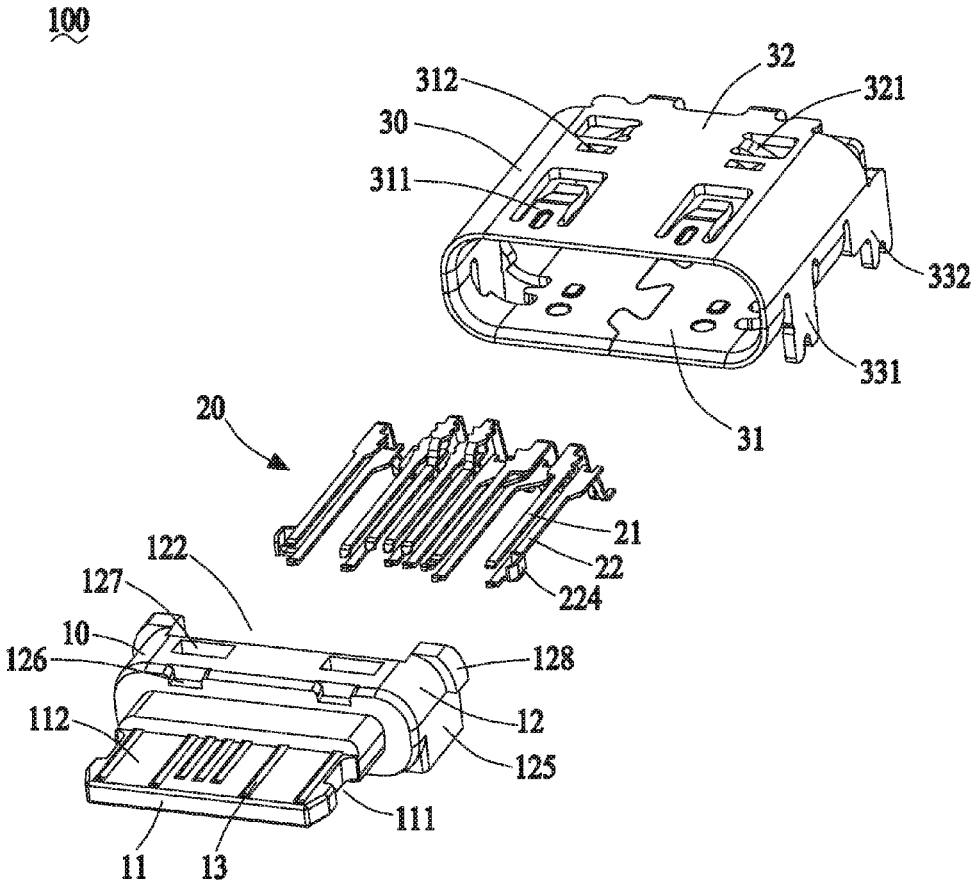
FIG. 2 is an exploded, perspective view of the electrical connector as shown in FIG. 1.
Figure 3:
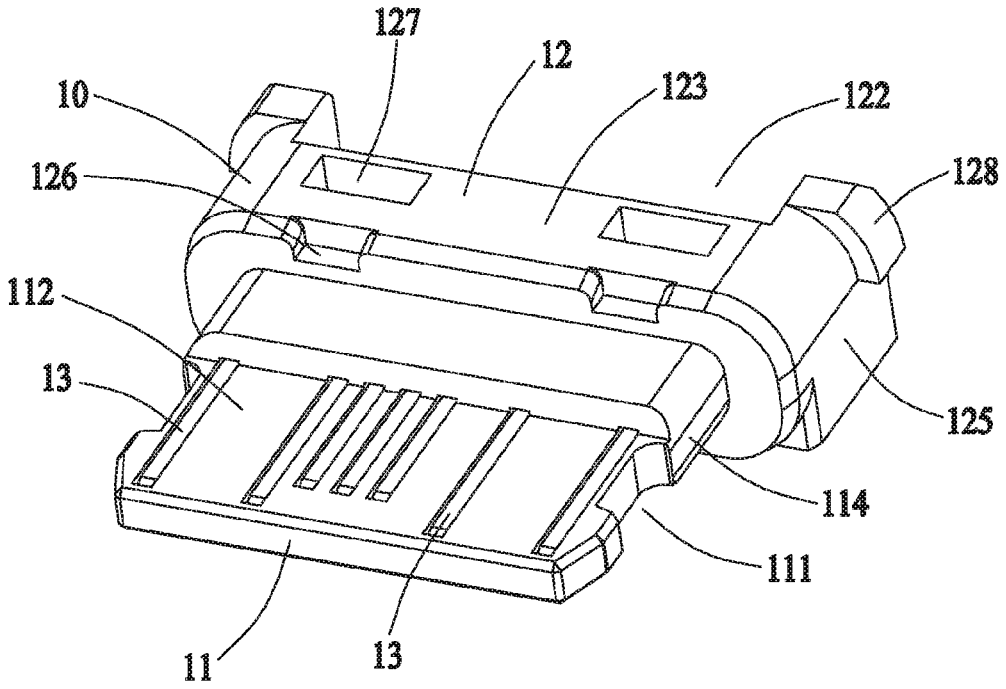
FIG. 3 is a perspective view of an insulating housing as shown in FIG. 2.
Figure 4:
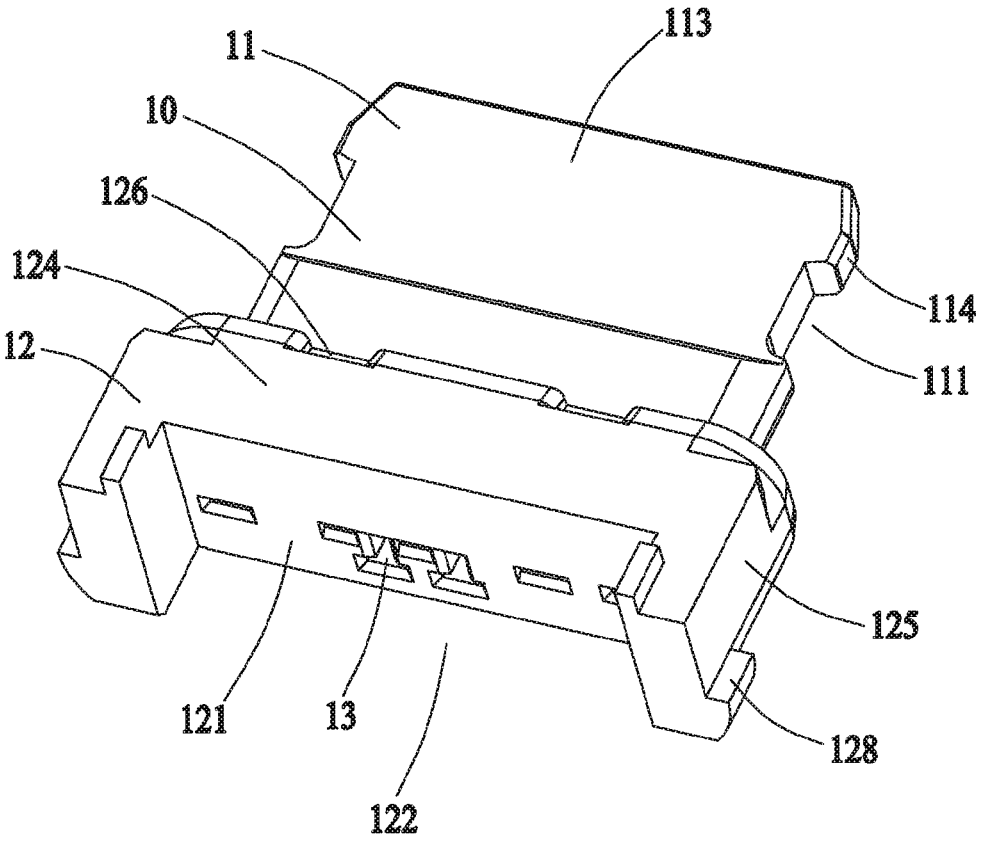
FIG. 4 is a perspective view of the insulating housing taken from another aspect.

Turning to FIGS. 3 and 4 with FIG. 2, the insulating housing 10 includes a mating tongue 11, a base 12 extending backwards from the mating tongue 11 and defines a plurality of channels 13. The channels 13 extend through the mating tongue 11 and the base 12. The dimensions of the mating tongue 11 either along an up-to-down direction or along a left-to-right direction are smaller than those of the base 12. The mating tongue 11 provides a pair of cutouts 111 at two opposite lateral edges thereof for cooperation with the complementary connector. The mating tongue 11 has an upper surface 112, a lower surface 113 opposite to the upper surface 112 and a pair of lateral edges 114 connecting the upper surface 112 and the lower surface 113. The cutout 111 is recessed from the lateral edge 114 and is located at a substantial middle position thereof.

The base 12 forms a back surface 121 confronting backwards and defines a receiving space 122 adjacent to the back surface 121 for receiving the conductive contacts 20. The base 12 includes a top wall 123, a bottom wall 124 opposite to the top wall 123, and two lateral side walls 125 connecting the top wall 123 and the bottom wall 124. Both the top wall 123 and the bottom wall 124 provide a pair of recesses 126 recessed at a junction between the mating tongue 11 and the base 12. In this preferred embodiment, the top wall 123 and the bottom wall 124 each has a pair of recesses 126. While, in other embodiment, it can be understood that the number of the recesses 126 is changeable according to applying condition. A pair of slots 127 are further defined behind the pair of recesses 126 along an engaging direction between the connector and the complementary connector. The pair of slots 127 neighbor to the back surface 121 of the base 12. A pair of blocks 128 protrude from rear ends of the opposite lateral side walls 125. The channels 13 are opened on the upper surface 112 of the mating tongue 11 and extend to the back surface 121 of the base 12.

Figure 5:
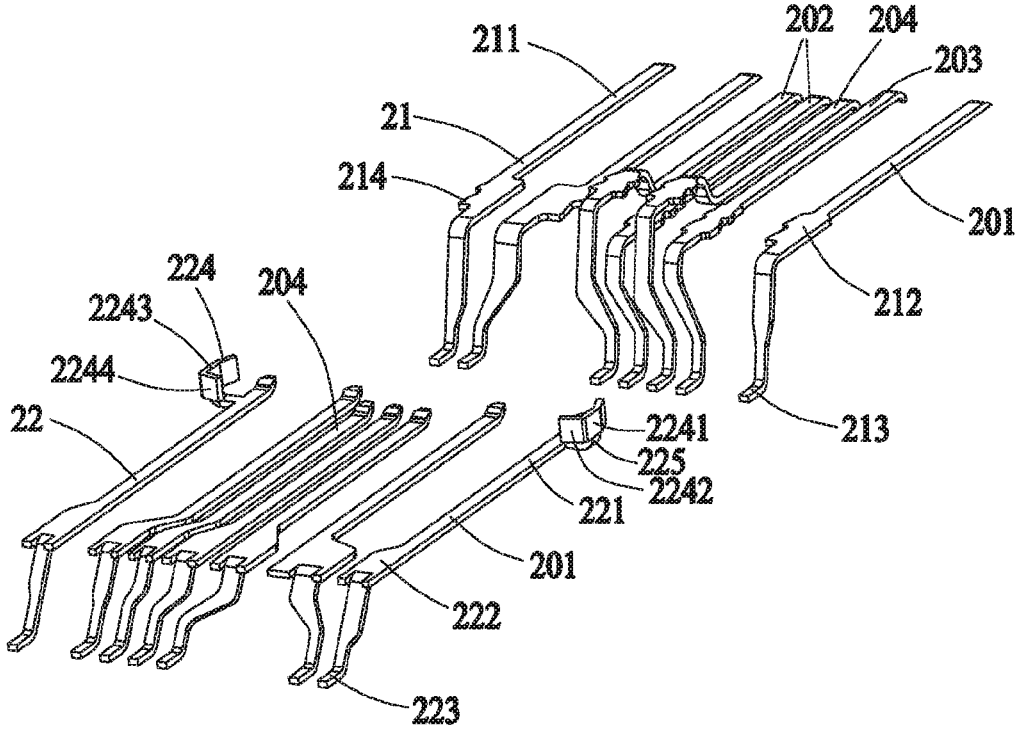
FIG. 5 is an exploded, perspective view of contacts as shown in FIG. 2.
Figure 6:
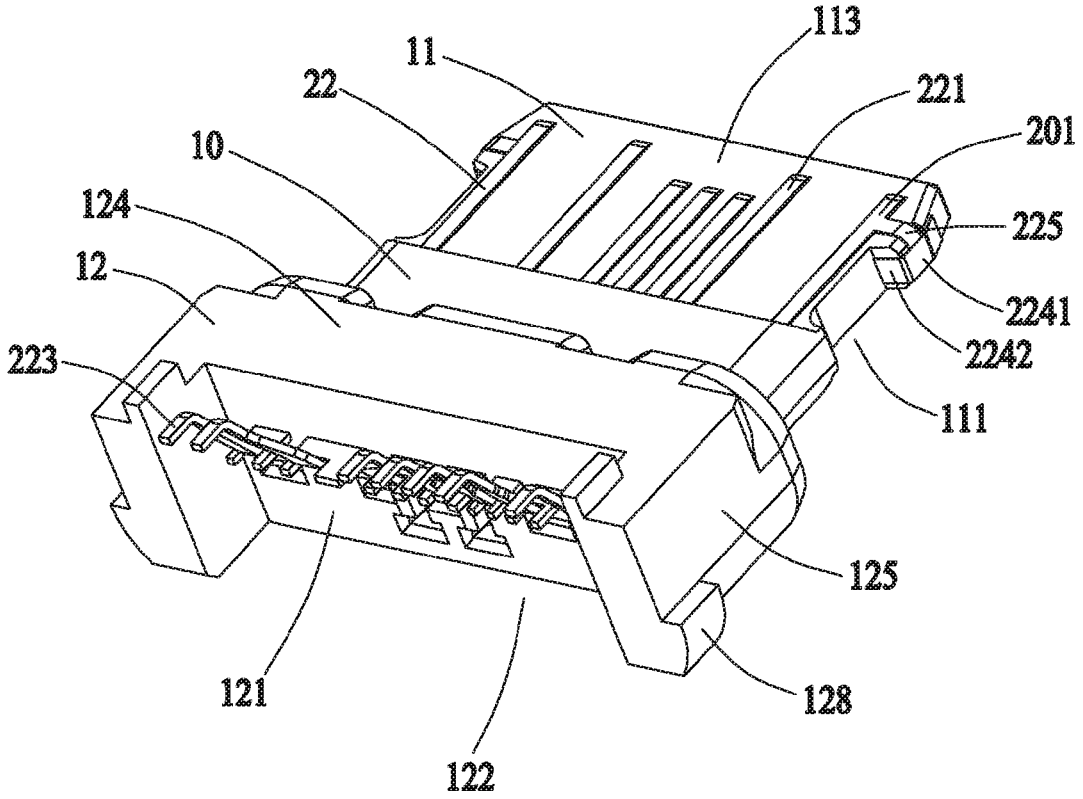
FIG. 6 is a partially assembled, perspective view of a lower row of contacts and the insulating housing after molding.

Together referring to FIGS. 5 and 6 with FIGS. 2-4, the plurality of conductive contacts 20 are arranged into an upper row and a lower row. The upper row of contacts 21 and the lower row of contacts 22 each include a pair of grounding contacts 201, a pair of power contacts 203, a pair of signal contacts 202 and one detecting contact 204. The pair of contacts 201 for grounding are arranged at opposite sides of the row of contacts 20. The pair of contacts 202 for signal transmission are arranged between the contacts 203 for power. As can be understood, the conductive contacts 20 of the present invention are arranged complying to the interface standard of the USB Type-C™. The pair of signal contacts 202 can be employed to transmit differential pairs and can be reversely arranged at the upper row of contacts 21 with respective to the lower row of contacts 22. The signal transmission will be stable when the complementary connector connects with the present invention with ignoring the insertion directions of the complementary connector.

The upper row of contacts 21 are received within the corresponding channels 13, and each contact 21 comprises a first contacting portion 211, a first fixing portion 212 from which the contacting portion 211 extends, and a first soldering portion 213 extending beyond the insulating housing 10. In the preferred embodiment, the first contacting portions 211 of the upper row of contacts 21 are exposed to the air from the upper surface 112 of the mating tongue 11 to thereby establishing electrical connection with the complementary connector. The first fixing portion 212 forms a barb 214 thereon for facilitating engagement with the channel 13.

The lower row of contacts 22 are received within the corresponding channels 13, and each contact 22 comprises a second contacting portion 221, a second fixing portion 222 from which the contacting portion 221 extends, and a second soldering portion 223 extending beyond the insulating housing 10. In the preferred embodiment, the second contacting portions 221 of the lower row of contacts 22 are exposed to the air from the lower surface 113 of the mating tongue 11 to thereby establishing electrical connection with the complementary connector. The first contacting portions 211 are opposite arranged with respective to the second contacting portions 221. The first soldering portions 213 and the second soldering portions 223 are arranged along one row to thereby surface-mounted to the printed circuit board.

The grounding contact 201 of the lower row of contacts 22 forms a latching portion 224, which is positioned adjacent to the second contacting portion 221. The latching portion 224 also neighbors to the cutout 111 to thereby secure with the complementary connector. The grounding contact 201 has an intermediate section 225 interconnecting the latching portion 224 and the second contacting portion 221. In this embodiment, the intermediate section 225 is formed in an L-shape so that the latching portion 224 and the second contacting portion 221 are extending along different planes. The two different planes can be either perpendicular to each other or parallel to each other. In this first embodiment, the planes are substantial perpendicular to each other. The latching portion 224 has an engaging face 2241 exposed outwards from the lateral edge 114 of the mating tongue 11 and a retaining face 2242 exposed within the cutout 111. The engaging face 2241 is employed to electrically connecting with the complementary connector. The engaging face 2241 and the retaining face 2242 are interconnected with and extend perpendicularly each other. In this embodiment, due to the L-shaped intermediate section 225, the latching portion 224 extends along a perpendicular direction to the second contacting portion 221. The latching portion 224 provides an engaging portion 2243 located at the lateral edge 114 of the mating tongue 11 and a retaining portion 2244 bent and extending towards the cutout 111 from the engaging portion 2243. The engaging face 2242 is formed on the engaging portion 2243 and the retaining face 2242 is formed on the retaining portion 2244. The intermediate section 225 exposed outwards on the mating tongue 11. While, in other embodiment, the intermediate section 225 can be also embedded into the mating tongue 11.

Figure 7:
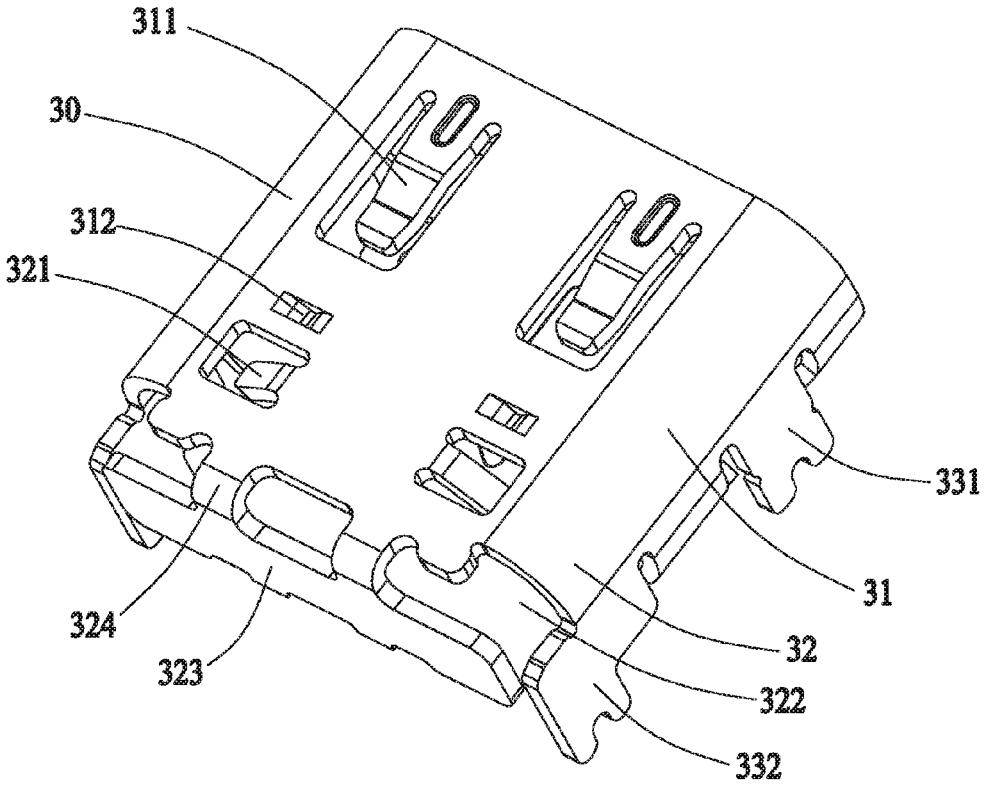
FIG. 7 is a perspective view of a shielding shell shown in FIG. 2.
Figure 8:
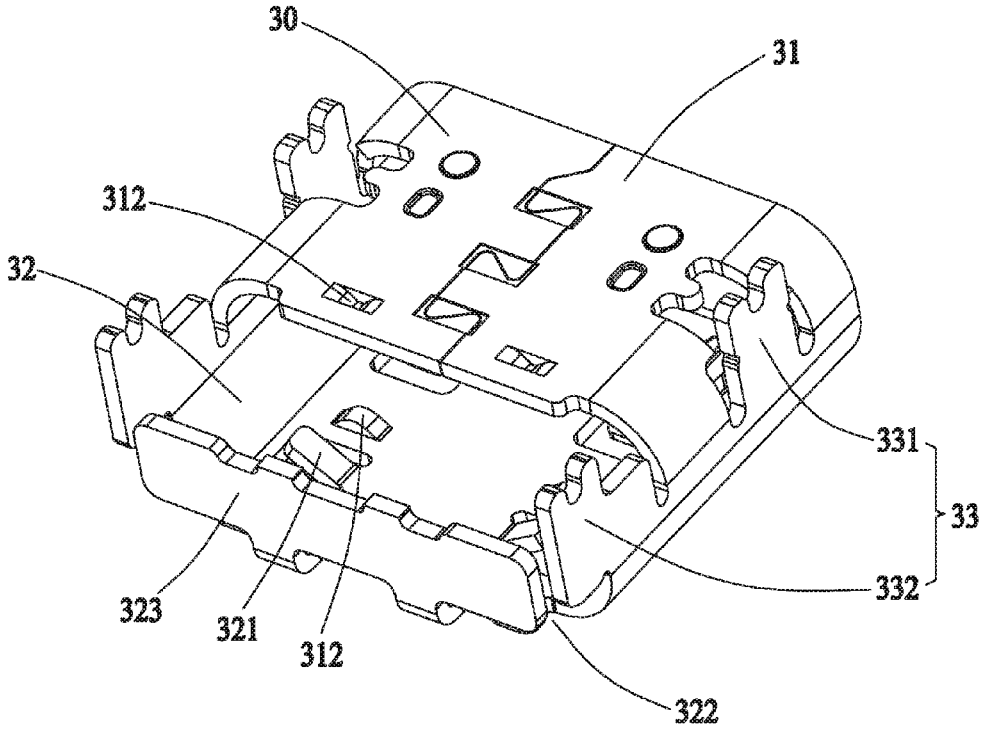
FIG. 8 is another perspective view of the shielding shell taken from different aspect.

Referring to FIGS. 7 and 8 together with the FIGS. 2-4, the shielding shell 30 includes a front shell 31 enclosing the mating tongue 11 and a rear shell 32 enclosing the base 12. The front shell 31 and the rear shell 32 can be formed either in one piece or in two pieces. The cross-section of the front shell 31 is an ellipse. The front shell 31 provides a pair of backwards extended tabs 311 for maintain a secured connection with the complementary connector. A pair of protrusions 312 are formed at upper side and lower side of the front shell 31. The pair of protrusions 312 extend into and engage with corresponding recesses 126. A pair of resilient tabs 321 are formed on the rear shell 32 and extend to the slots 127 for secure the shielding shell 30 to the insulating housing 10. The protrusions 312 and the resilient tabs 321 are correspondingly arranged along a front-to-back direction. Turning to FIG. 7, a pair of openings 322 are formed oppositely at the rear side of the rear shell 32 for retaining the blocks 128. The engagements between the resilient tabs 321 and the slots 127, the protrusions 312 and the recesses 126, and the engagement between the openings 322 and the blocks 128, secure the connection between the shielding shell 30 with the insulating housing 10.

The rear shell 32 includes a rear wall 323 covering the receiving space 122. The first soldering portions 213 and the second soldering portions 223 which extend within the receiving space 122 are protected by the rear wall 323 to thereby avoid undesired touching. The rear shell 32 also has a pair of connecting portions 324 connecting the rear wall 323 with a top wall of the rear shell 32. The rear wall 323 is perpendicular to the top wall. The shielding shell 30 comprises a plurality of solder feet 33 for soldering onto the printed circuit board. The solder feet 33 comprise first solder feet 331 located at opposite sides of the front shell 31 and second solder feet 332 located at opposite sides of the rear shell 32.

During assembling of the present invention, the lower row of contacts 22 are insert-molded within the insulating housing 10 and the second contacting portions 221 are exposed from the lower surface 113 of the mating tongue 11. Then, the upper row of contacts 21 are inserted into the corresponding channels 13 from the back surface 121 and the first contacting portions 211 are exposed from the upper surface 112 of the mating tongue 11. Finally, the shielding shell 30 is assembled to the insulating housing 10 and the conductive contacts 20.

Figure 9:
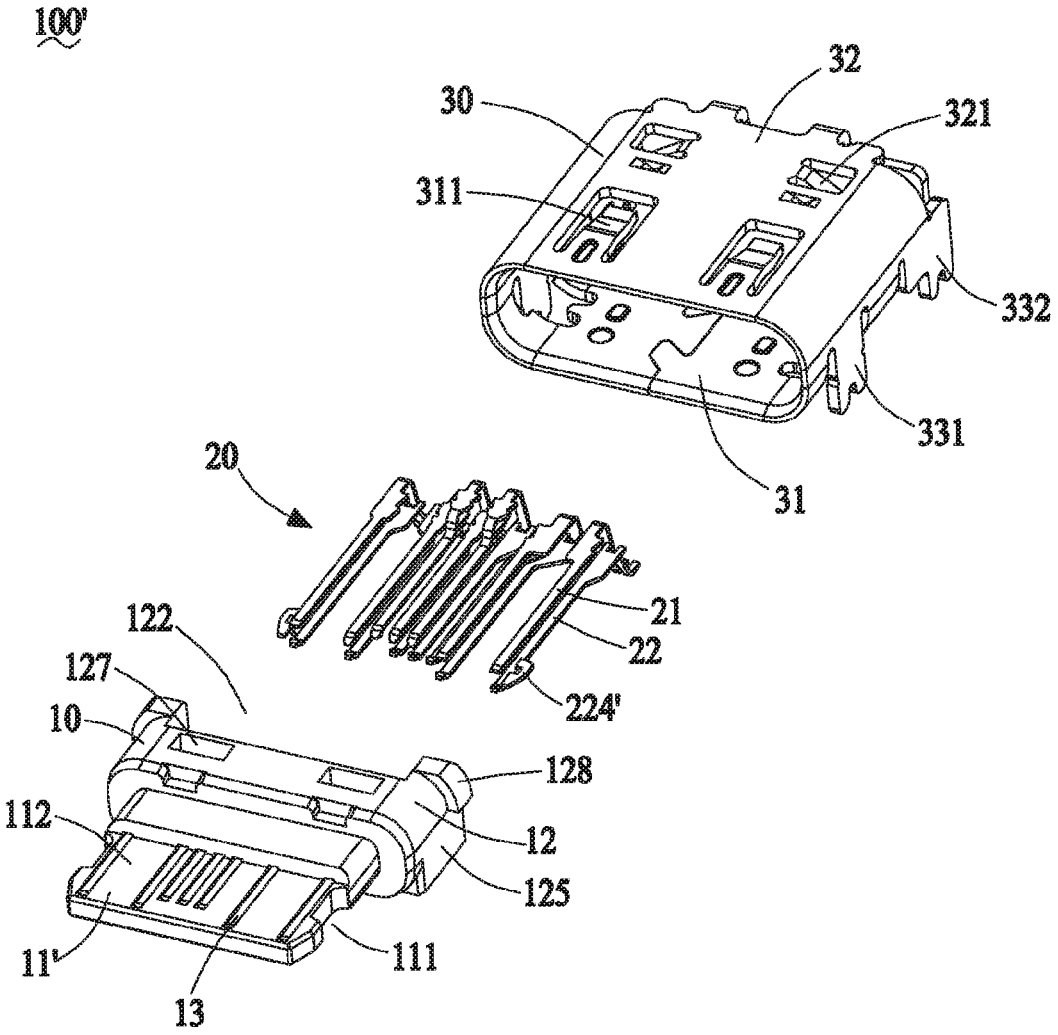
FIG. 9 is an explored, perspective view of the electrical connector of the second embodiment.
Figure 10:
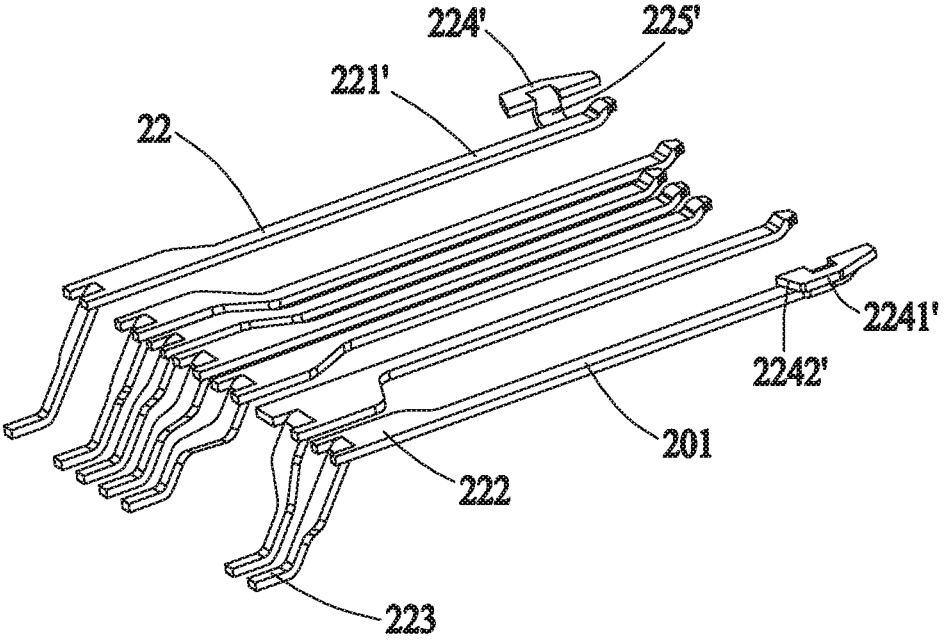
FIG. 10 is a perspective view of the lower row of contacts shown in FIG. 9.
Figure 11:
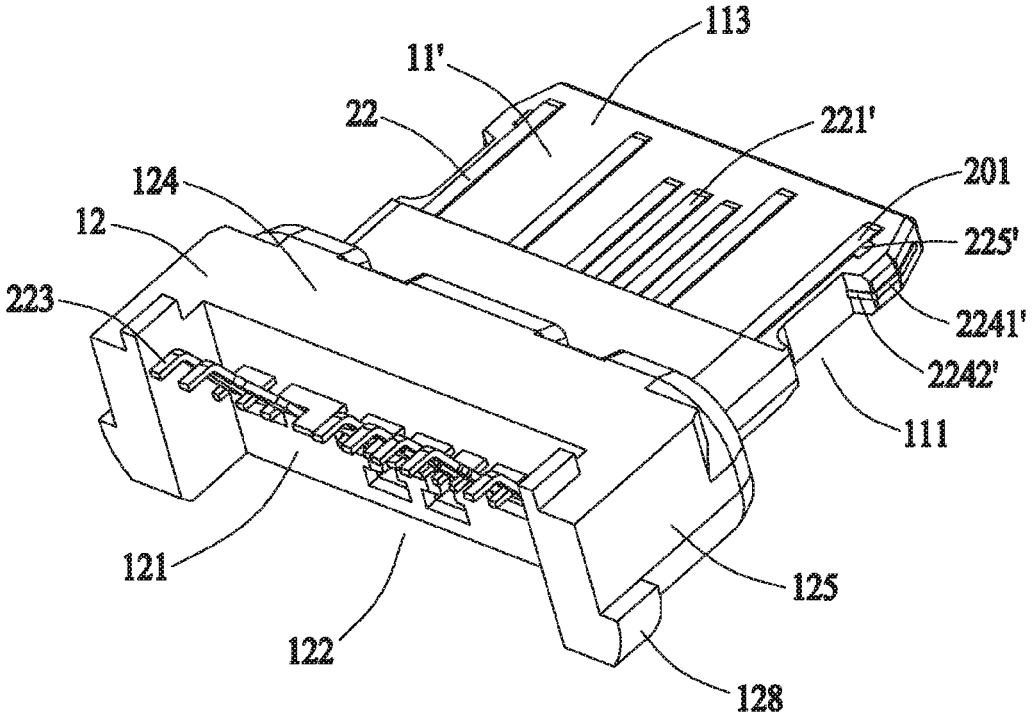
FIG. 11 is a partially assembled, perspective view of the lower row of contacts and the insulating housing shown in FIG. 10.

Referring to FIGS. 9-11, the second embodiment of the present invention is illustrated. The electrical connector 100' has a similar structure to the electrical connector 100 of the first embodiment. The details of the latching portion 224' are different. In this second embodiment, the latching portion 224' extends parallel to the second contacting portion 221' with an engaging face 2241' and the retaining face 2242' being positioned at opposite ends of the latching portion 224'. The intermediate section 224' is insert-molded within the mating tongue 11'. As can be understood, the intermediate portion 225' could be also exposed to the outside of the mating tongue 11'.

It should be noted here that, the interface of the electrical connector 100, 100' of the present invention complies to the USB Type-C™ standard. Furthermore, the latching portion 224, 224' of such electrical connector 100, 100' is compliant with the USB 3.1 specification. The latching portion 224, 224' establishes both the mechanical and the electrical connection with the complementary connector, simultaneously. In conclusion, the application of the latching portion 224, 224', which is formed with the grounding contact 201 and extends along different plane of the contacting portion 221, 221', simplifies the whole structure while maintains enough insertion forces of the connector. No more central grounding means should be used.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector for electrically connecting with a complementary connector, comprising:

an insulating housing comprising a base, a mating tongue extending forwards from the base, and a plurality of channels extending through the mating tongue and the base;

a plurality of conductive contacts retained in the channels, each conductive contact having a fixing portion assembled within corresponding channel, a contacting portion extending from one side of the fixing portion and a soldering portion extending from the other side of the fixing portion opposite to the contacting portion; and a shielding shell covering the insulating housing and the plurality of conductive contacts;

wherein the plurality of conductive contacts comprises at least one grounding contact, and the at least one grounding contact defines a latching portion neighbored and connected to the contacting portion thereof; and wherein the mating tongue has a pair of cutouts recessed from opposite lateral edges thereof, and the latching portion of the at least one grounding contact cooperates with one of the pair of cutouts;

wherein the contacting portion of the at least one grounding contact and the latching portion of the at least one grounding contact extend within two different planes;

wherein the latching portion of the at least one grounding contact provides an engaging portion for electrically connecting with the complementary connector and a retaining portion extending from the engaging portion and projecting into the cutout; and wherein the retaining portion extends along a substantially perpendicular direction of the engaging portion of the at least one grounding contact.

2. The electrical connector as claimed in claim 1, wherein the two different planes are vertical to each other.

3. The electrical connector as claimed in claim 1, wherein the two different planes are parallel to each other.

4. The electrical connector as claimed in claim 3, wherein the latching portion of the at least one grounding contact extends parallel to the contacting portion of the at least one grounding contact, and wherein the at least one grounding contact forms an intermediate section connecting the contacting portion and the latching portion.

5. The electrical connector as claimed in claim 4, wherein the intermediate section is embedded in the lateral edge of the mating tongue and wherein the intermediate section provides an engaging face and a retaining face exposed to the outside.

6. The electrical connector as claimed in claim 1, wherein the at least one grounding contact forms an intermediate section connecting the contacting portion and the latching portion and wherein the intermediate section formed in an L-shape.

7. The electrical connector as claimed in claim 6, wherein the engaging portion of the latching portion provides an engaging face and the retaining portion of the latching portion provides a retaining face perpendicular to the engaging face, and wherein the retaining face confronts backwards.

8. The electrical connector as claimed in claim 1, wherein the plurality of conductive contacts includes an upper row of contacts and a lower row of contacts.

9. The electrical connector as claimed in claim 8, wherein each row of contacts comprises two grounding contacts, and wherein each grounding contact is formed with the latching portion.

10. The electrical connector as claimed in claim 9, wherein each row of contacts also comprises two contacts for power, two contacts for signals and one contact for detecting.

11. The electrical connector as claimed in claim 1, wherein the base comprises a top wall and a bottom wall opposite to the top wall.

12. The electrical connector as claimed in claim 11, wherein a pair of recesses are defined at a junction between the base and the mating tongue and wherein a pair of slots are defined behind the pair of recesses.

13. The electrical connector as claimed in claim 12, wherein the shielding shell forms a pair of protrusions retained in corresponding recesses and a pair of resilient tabs retained in corresponding slots for secure the shielding shell to the insulating housing.

14. The electrical connector as claimed in claim 1, wherein distal ends of the soldering portions of the conductive contacts are arranged in one row and distal ends of the contacting portions of the conductive contacts are arranged in at least two rows staggered along a front-to-back direction.

15. An electrical connector for electrically connecting with a complementary connector, comprising:

an insulating housing comprising a base, a mating tongue extending forwards from the base, and a plurality of channels extending through the mating tongue and the base;

a plurality of conductive contacts retained in the channels, each conductive contact having a fixing portion assembled within corresponding channel, a contacting portion extending from one side of the fixing portion and a soldering portion extending from the other side of the fixing portion opposite to the contacting portion; and a shielding shell covering the insulating housing and the plurality of conductive contacts;

wherein the plurality of conductive contacts comprises at least one grounding contact, and the at least one grounding contact defines a latching portion neighbored and connected to the contacting portion thereof; and wherein the mating tongue has a pair of cutouts recessed from opposite lateral edges thereof, and the latching portion of the at least one grounding contact cooperates with one of the pair of cutouts;

wherein the contacting portion of the at least one grounding contact and the latching portion of the at least one grounding contact extend within two different, parallel planes;

wherein the latching portion of the at least one grounding contact extends parallel to the contacting portion of the at least one grounding contact, and wherein the at least one grounding contact forms an intermediate section connecting the contacting portion and the latching portion; and wherein the intermediate section is embedded in the lateral edge of the mating tongue and wherein the intermediate section provides an engaging face and a retaining face exposed to the outside.

16. An electrical connector for electrically connecting with a complementary connector, comprising:

an insulating housing comprising a base, a mating tongue extending forwards from the base, and a plurality of channels extending through the mating tongue and the base, the base comprising a top wall and a bottom wall opposite to the top wall;

a plurality of conductive contacts retained in the channels, each conductive contact having a fixing portion assembled within corresponding channel, a contacting portion extending from one side of the fixing portion and a soldering portion extending from the other side of the fixing portion opposite to the contacting portion; and a shielding shell covering the insulating housing and the plurality of conductive contacts;

wherein the plurality of conductive contacts comprises at least one grounding contact, and the at least one grounding contact defines a latching portion neighbored and connected to the contacting portion thereof; and wherein the mating tongue has a pair of cutouts recessed from opposite lateral edges thereof, and the latching portion of the at least one grounding contact cooperates with one of the pair of cutouts;

wherein the contacting portion of the at least one grounding contact and the latching portion of the at least one grounding contact extend within two different planes;

wherein a pair of recesses are defined at a junction between the base and the mating tongue and wherein a pair of slots are defined behind the pair of recesses, and wherein the shielding shell forms a pair of protrusions retained in corresponding recesses and a pair of resilient tabs retained in corresponding slots for secure the shielding shell to the insulating housing.

* * * * *